US012492597B1

(12) United States Patent
Reed

(10) Patent No.: US 12,492,597 B1
(45) Date of Patent: Dec. 9, 2025

(54) AIR ROTARY SYSTEM FOR A DOWN HOLE DRILL ASSEMBLY

(71) Applicant: Center Rock, Inc., Berlin, PA (US)

(72) Inventor: Daniel J. Reed, Alum Bank, PA (US)

(73) Assignee: Center Rock, Inc., Berlin, PA (US)

( * ) Notice: Subject to any disclaimer, the term of this patent is extended or adjusted under 35 U.S.C. 154(b) by 0 days.

(21) Appl. No.: 18/738,668

(22) Filed: Jun. 10, 2024

(51) Int. Cl.
*E21B 4/00* (2006.01)
*E21B 4/02* (2006.01)
*E21B 7/06* (2006.01)

(52) U.S. Cl.
CPC ..... *E21B 4/006* (2013.01); *E21B 4/02* (2013.01); *E21B 7/067* (2013.01)

(58) Field of Classification Search
CPC ..... E21B 4/006; E21B 4/02; E21B 7/067
See application file for complete search history.

(56) References Cited

U.S. PATENT DOCUMENTS 8,607,897 B2 * 12/2013 Kolle ..... E21B 4/006 175/71
11,346,201 B2 * 5/2022 Deolalikar ..... G01V 11/005
2007/0137897 A1 * 6/2007 Sanders ..... E21B 7/067 175/73
2010/0187009 A1 * 7/2010 Siher ..... E21B 4/02 175/57
2021/0170564 A1 * 6/2021 Gehret ..... B25F 5/001
2022/0193878 A1 * 6/2022 Tomayko ..... B25B 21/02

* cited by examiner

*Primary Examiner* — Shane Bomar
(74) *Attorney, Agent, or Firm* — Kim IP Law Group

(57) ABSTRACT

A drill assembly is provided having a main housing. A tool mount housing is rotatably engaged to the main housing. An air motor is mounted within the main housing and includes an air motor drive shaft. The air motor drive shaft has an upper sun gear attached to it. The air motor drive shaft and upper sun gear are positioned within a first stage ring gear within the main housing. A second stage ring gear is similarly positioned within the tool mount housing. A plurality of planet gears is positioned in between the upper sun gear and the first and second ring gears. When the upper sun gear is rotated, the planet gears are rotated around the first stage ring gear. The rotation of the planet gears rotates tool mount housing by engaging the second stage ring gear.

25 Claims, 22 Drawing Sheets

AIR ROTARY SYSTEM FOR A DOWN HOLE DRILL ASSEMBLY

The present disclosure relates generally to down-the-hole drill assemblies and, more specifically, to an air rotary system for a down hole drill assembly.

BACKGROUND OF THE DISCLOSURE

Directional drilling is the process of drilling non-vertical down holes. It is commonly required in the utility industry to route pipes and wires under or around existing infrastructure. It is also utilized in the geothermal industry to install pipes. It is also used in the oil and gas industry to increase production with fewer bores. One method of directional drilling uses a short section of drill string that has a predetermined angle change. This is commonly referred to as a bent sub. The direction that the bend is pointing is tracked by on board instrumentation or physically marking the drill string. To drill straight, the entire drill string is rotated by the drill rig. To change direction, the drill rig stops rotation, points the bend in the desired direction, and then rotates just the portion of the drill string below the bend. A short distance from the bit to the bend is desirable as it reduces bit offset, enables a steeper angle to be drilled and reduces bending stress in the components. It would therefore be desirable to have a compact and efficient below the bend drill rig assembly.

BRIEF SUMMARY OF THE DISCLOSURE

In accordance with one aspect of the disclosure there is provided an air rotary system for a down-the-hole drill assembly having a housing including an air motor mounted within. A compound planetary gear is mounted within the housing. An output ring gear operationally engages the compound planetary gear.

According to a further aspect, the air rotary system may include a thrust plate in between the motor and the compound planetary gear and a second thrust plate between the output ring gear and the compound planetary gear. According to a further aspect, the air rotary system includes a mounting assembly for mounting the air motor to the housing. According to a further aspect, the housing may include an outer ring gear integrally formed on an inner surface of the housing. According to a further aspect, the air motor may be operatively connected to the compound planetary gear for driving rotation of the compound planetary gear. According to a further aspect, the compound planetary gear may include a pair of gears connected and longitudinally arranged. According to a further aspect, each of the pair of gears may have different radii. According to a further aspect, the pair of gears may be sized sufficiently to produce an overall gear ratio of about 90:1 to 108:1, in another aspect it could be configured to 106:1 if a slower rotation on the output was desired. According to a further aspect, the compound planetary gear may comprise a sub gear assembly operational engaged to the air motor. According to still a further aspect, the output ring gear may include a connector for connecting to a drilling component and may include a diameter sized less that the diameter of the outer ring gear.

In accordance with another aspect of the disclosure there is provided a rotary assembly for down hole drilling. The rotary assembly includes a first tool joint connection, a bent sub connected to the first tool joint connection, and an air rotary system operatively connected to the bent sub. The air rotary system may include a housing, a single air motor mounted therein, a compound planetary gear mounted therein, and an output ring gear operatively engaged with the compound planet gear. In another aspect, the rotary assembly may include a second tool joint connected to the air rotary system.

In accordance with another aspect of the disclosure there is provided a down-the-hole drill assembly having a main housing having an exterior main housing surface and an interior main housing surface. A tool mount housing is rotatably engaged to the main housing. The tool mount housing has an exterior tool mount surface and an interior tool mount surface. An air motor is mounted within the main housing and includes an air motor drive shaft. The air motor drive shaft has an upper sun gear attached to it. The air motor drive shaft and upper sun gear are positioned within a first stage ring gear positioned within the main housing. A second stage ring gear is similarly positioned within the tool mount housing. A plurality of planet gears is positioned in between the upper sun gear and the first and second ring gears. When the upper sun gear is rotated by the air motor drive shaft, the planet gears are rotated around the first stage ring gear. The rotation of the planet gears rotates the second stage ring gear within the tool mount housing and therefore rotates the tool mount housing itself. In this arrangement, improved gear ratio is achieved in a compact and robust assembly.

According to an aspect, each of the plurality of planet gears includes a planet gear shaft with an upper planet gear and a lower planet gear affixed thereto. The upper planet gear is positioned in between the upper sun gear and the first stage main gear. The lower planet gear is positioned between a lower sun gear and the second stage ring gear. According to another aspect, the upper planet gear has a diameter greater than the lower planet gear. According to another aspect, lower planet gear has fewer teeth than the upper planet gear. According to another aspect, second stage ring gear has fewer teeth than the first stage ring gear.

In accordance with another exemplary aspect the drill may include a first main housing with a main housing axis and a bent main housing with a bent main housing axis. The bent main housing axis is angled greater than 3 degrees from the main housing axis, in another aspect it can be less than 3 degrees. The air motor is mounted to a motor mount assembly positioned in the bent main housing. The motor mount housing includes a motor mount plate and a plurality of motor mount L-brackets positioned around its perimeter. The L-brackets engage and lock into an air motor ridge formed in the air motor to secure the air motor within the bent main housing.

In accordance with another exemplary aspect the drill may include an upper thrust plate in communication with a first shaft end of the planet gear shaft and a lower thrust plate rotationally in communication with a second shaft end of the planet gear shaft.

Other features and advantages of the subject disclosure will be apparent from the following more detailed description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1:
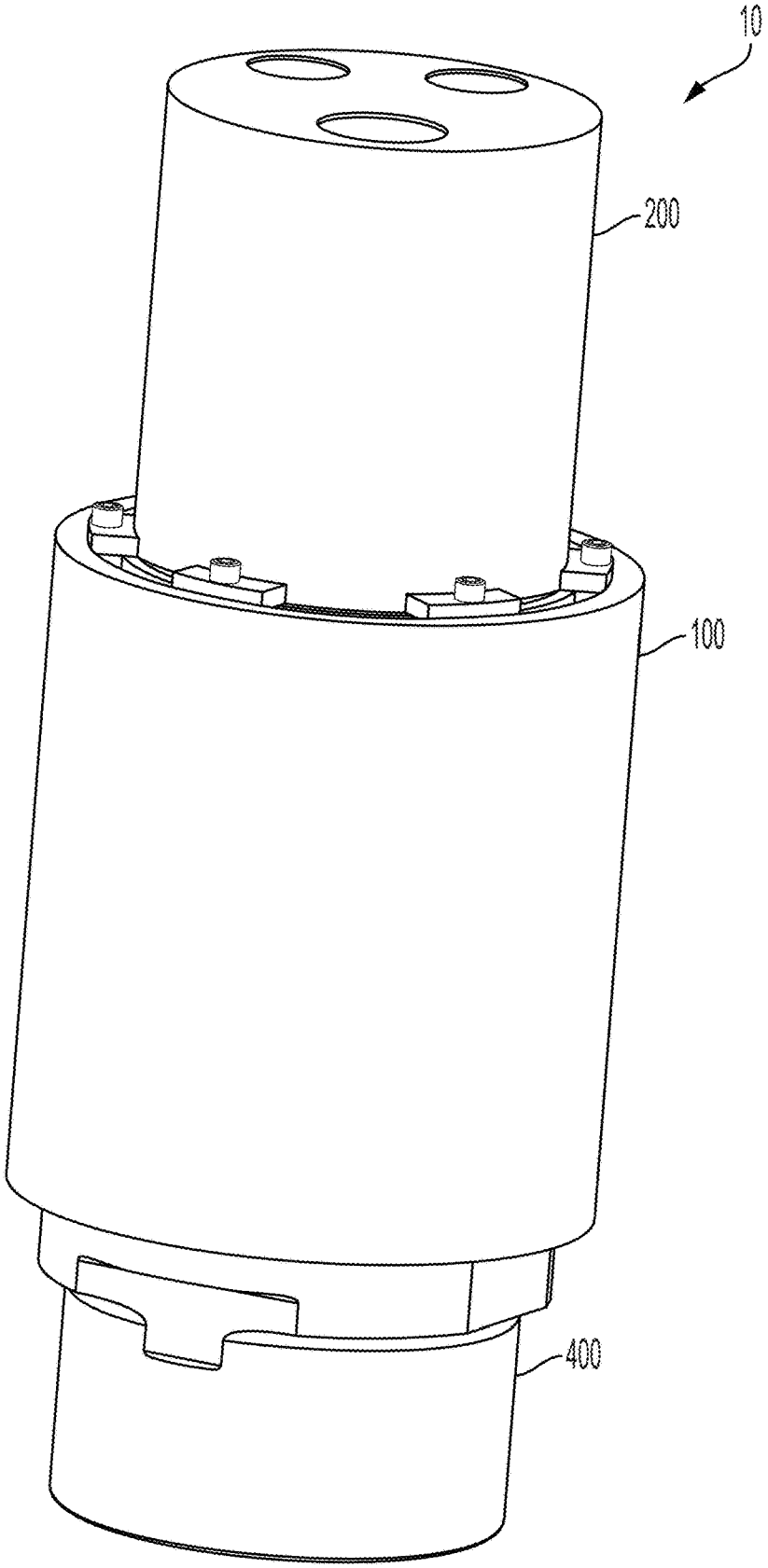
FIG. 1 is a side perspective view of an air rotary system for a down-the-hole drill assembly in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

In accordance with an exemplary embodiment, the subject disclosure provides an air rotary system 10 for a down-the-hole drill assembly that includes a housing 100, an air motor 200, a compound planetary gear 300, and an output ring gear 400, as best shown in FIGS. 1-20. The air motor is mounted within the housing. The compound planetary gear 300 is mounted within the housing. The output ring gear is operatively engaged with the compound planetary gear.

Figure 5:
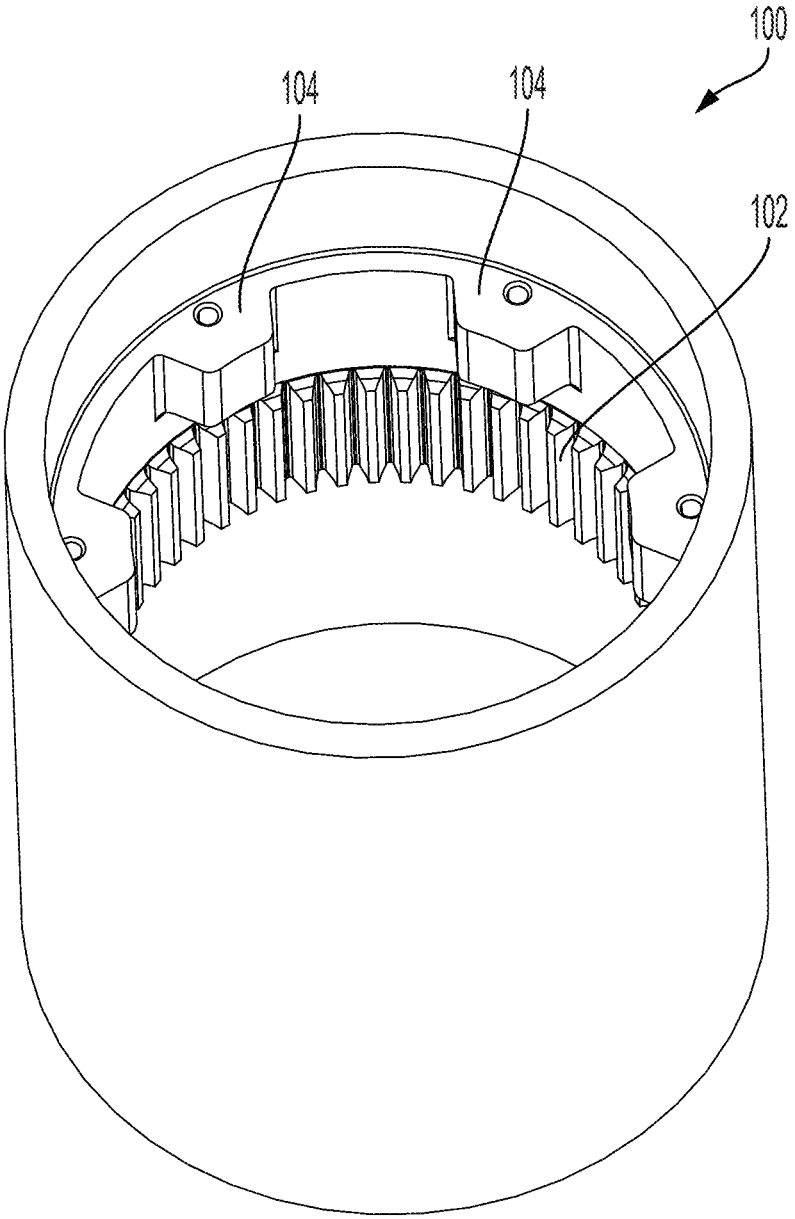
FIG. 5 is a perspective view of a housing of the air rotary system shown in FIG. 1.
Figure 6:
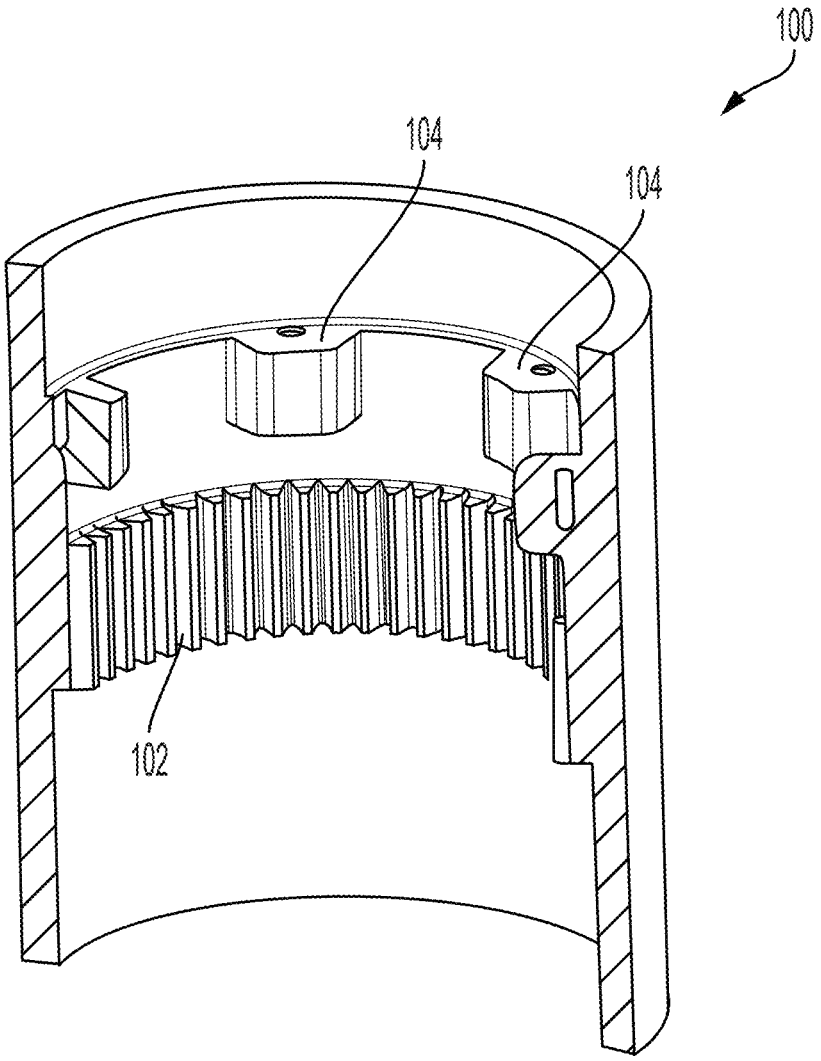
FIG. 6 is a longitudinal cross-sectional view of the housing shown in FIG. 5.

The housing 100 is configured as best shown in FIGS. 5 and 6. The housing 100 is a tubular housing having an overall length of about 5 to 20 inches, but can be more or less, such as 4, 6, 7, 8, 9, 10, 11, 12, 13, 14, 15, 16, 17, 18, 19, 25, 30, 35 or more inches. In one exemplary configuration the overall length is about 12.5 inches. The housing includes gears along its inner surface forming an outer ring gear 102. That is, the housing 100 comprises the outer ring gear 102. The outer ring gear 102 can be connected to the housing or integrally formed with the housing. For example, the outer ring gear can be machined into the housing wall or cast along with the housing. The outer ring gear 102 is positioned about a mid-point of a longitudinal length of the housing having a longitudinal length of about 1 to 3.5 inches, but can alternately be more or less e.g., 1.5, 2.0, 2.5 and 3.0 inches, and each tooth of the outer ring gear is sized sufficiently to operatively engage the compound planetary gear 300, as further discussed below. The number of teeth of the outer ring gear can be sized to provide a desired gear ratio for the air rotary system, such as 90:1-100:1, or more or less e.g., 50:1, 60:1, 70:1, 80:1, 85:1, 105:1, 110:1. The teeth of the compound planetary gear are sized to have a tooth thickness of about 5 to 7 mm, about 6 to 7 mm and of about 6.0 to 6.5 mm, but can be more or less e.g., 4, 4.5, 5.5, 6.1, 6.2, 6.3, 7.5, 8 etc. mm. The desired gear ratio of the air rotary system is a speed to torque ratio with the speed decreased by a ratio of 99:1 and the torque increased by a ratio of 99:1. Additionally, the foregoing ratios can be more or less e.g., 50:1, 75:1, 80:1, 90:1, 100:1, 110:1, 120:1, and 150:1.

Figure 2:
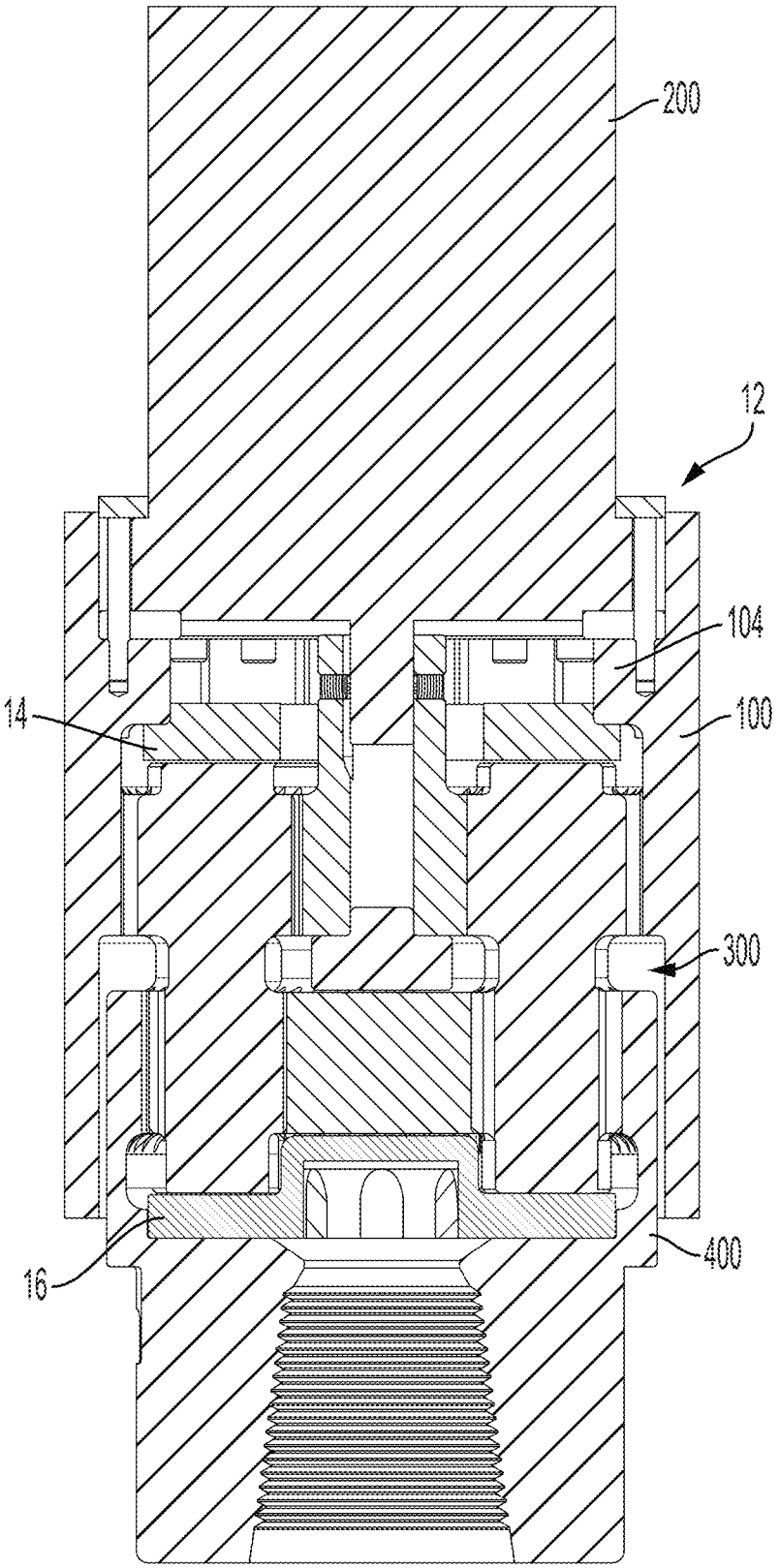
FIG. 2 is a longitudinal cross-sectional view of the air rotary system of FIG. 1.

The housing 100 also includes a plurality of mounts 104 for mounting the air motor 200 thereto via a mounting assembly 12 (FIG. 2). Each of the plurality of mounts 104 are circumferentially spaced apart. In the present exemplary embodiment, the housing includes six (6) mounts, but can alternatively include more or less than 6 mounts e.g., 2, 3, 4, 5, 7, 8, 9 and 10 mounts. Alternatively, the plurality of mounts can be configured as a unitary mount e.g., a circumferential flange.

Figure 7:
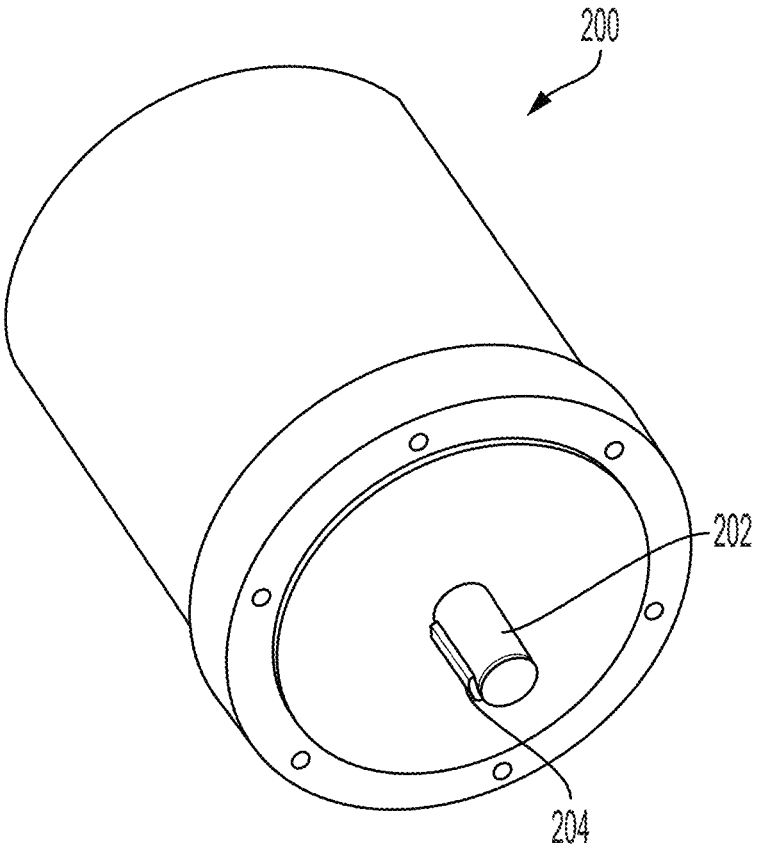
FIG. 7 is a perspective view of an air motor of the air rotary system of FIG. 1.
Figure 8:
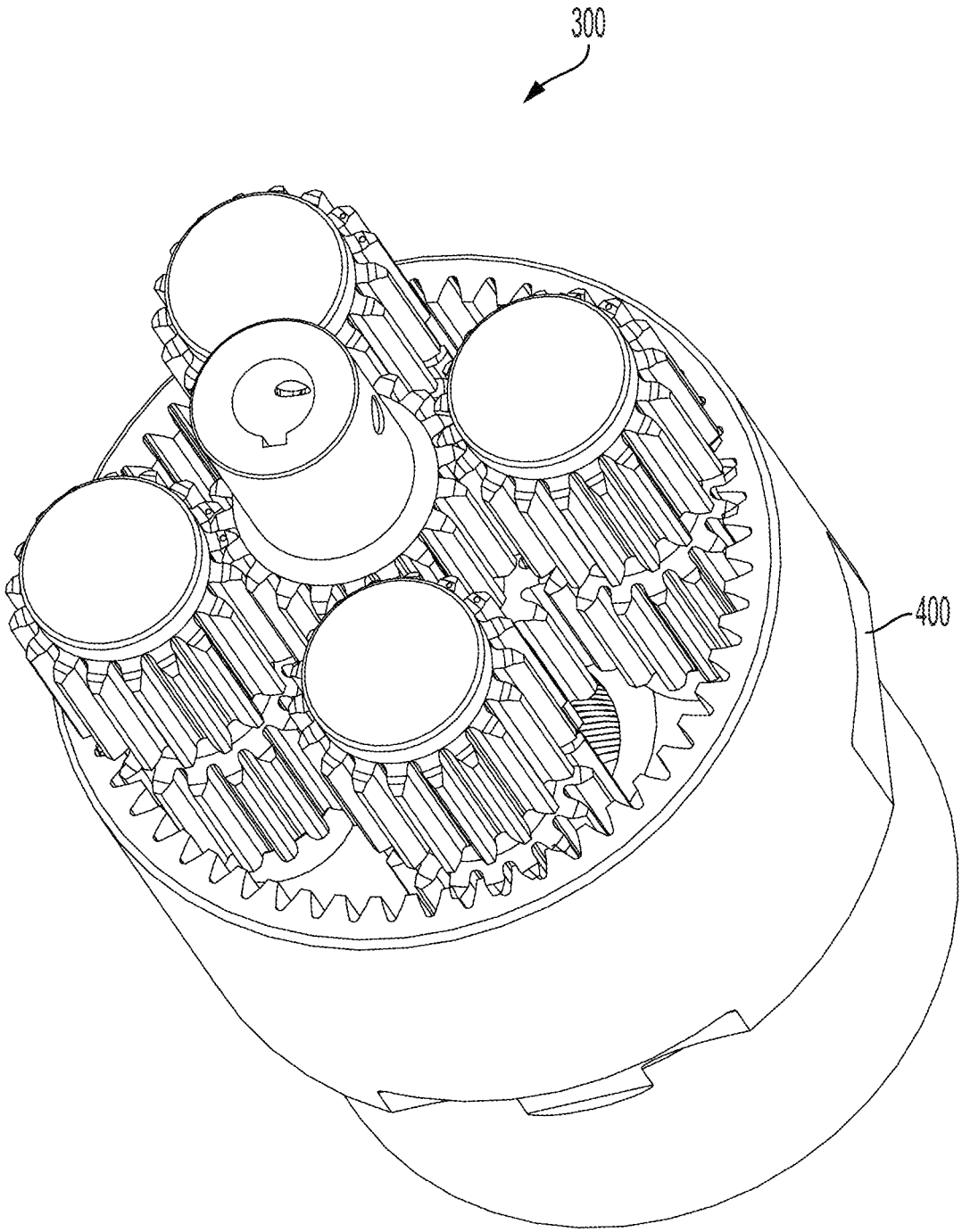
FIG. 8 is a perspective view of a compound planetary gear of the air rotary system of FIG. 1.
Figure 9:
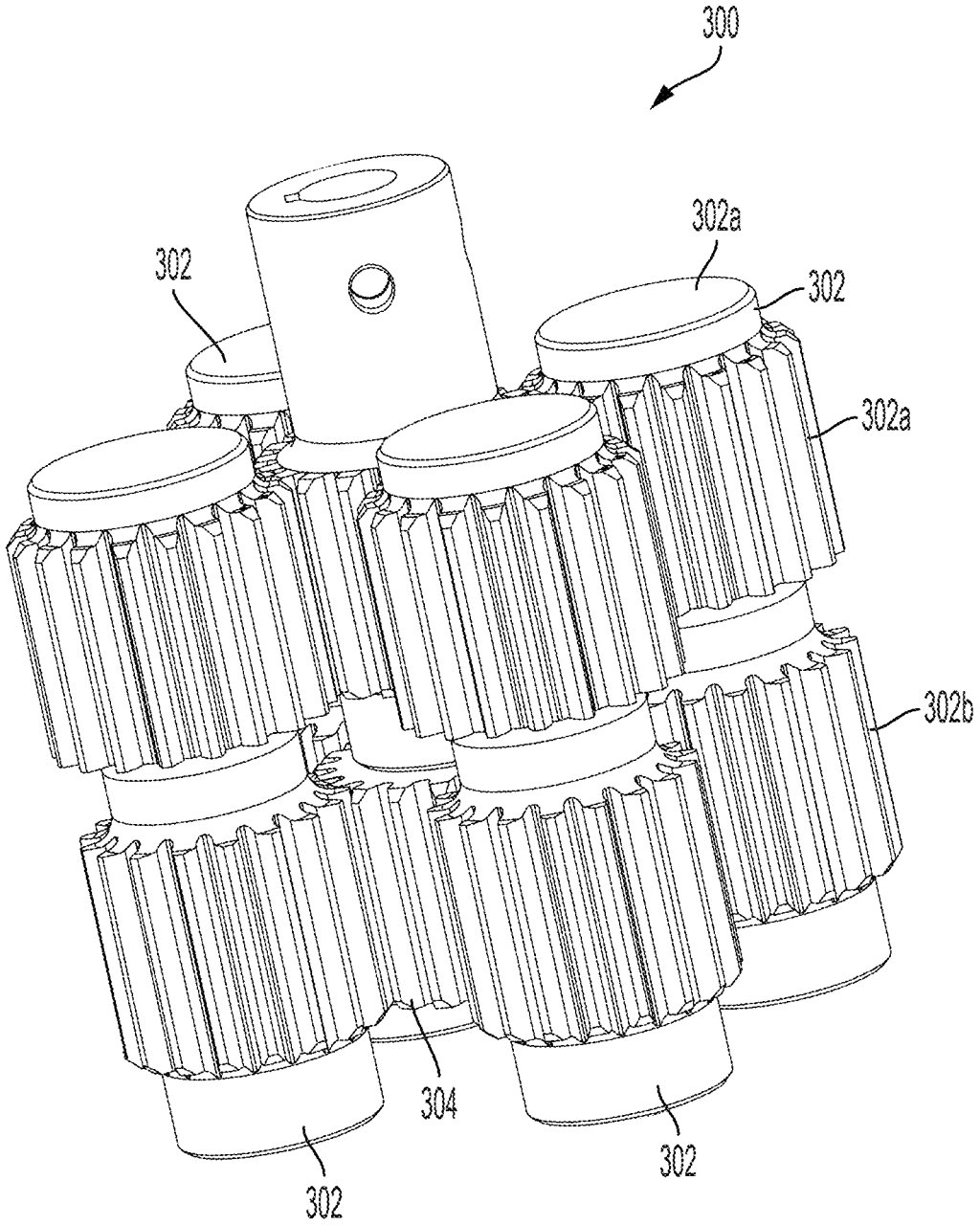
FIG. 9 is a perspective view of the compound planetary gear shown in FIG. 8.
Figure 10:
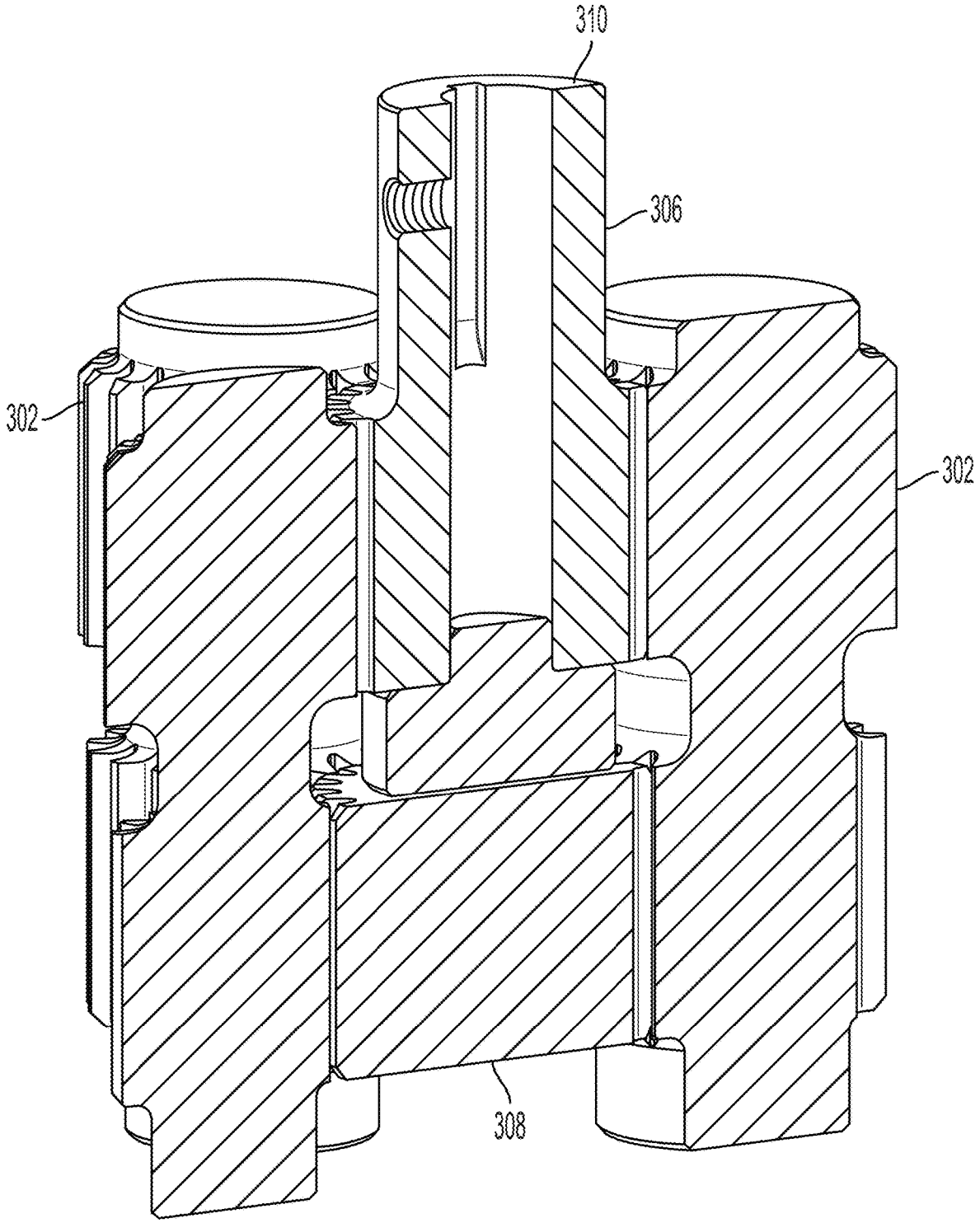
FIG. 10 is a longitudinal cross-sectional view of the compound planetary gear of FIG. 9.
Figure 11:
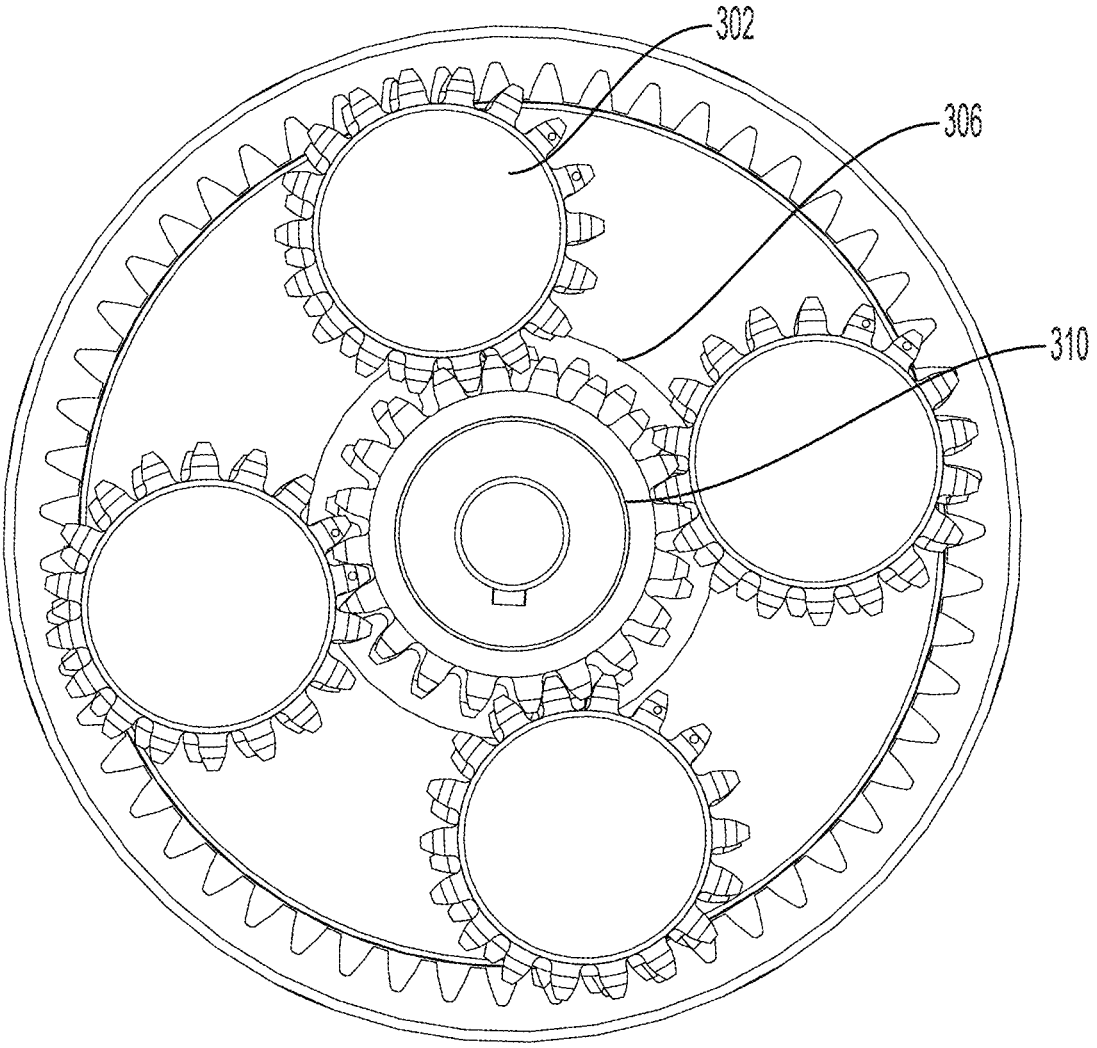
FIG. 11 is a top plan view of the compound planetary gear and housing shown in FIG. 8.
Figure 12:
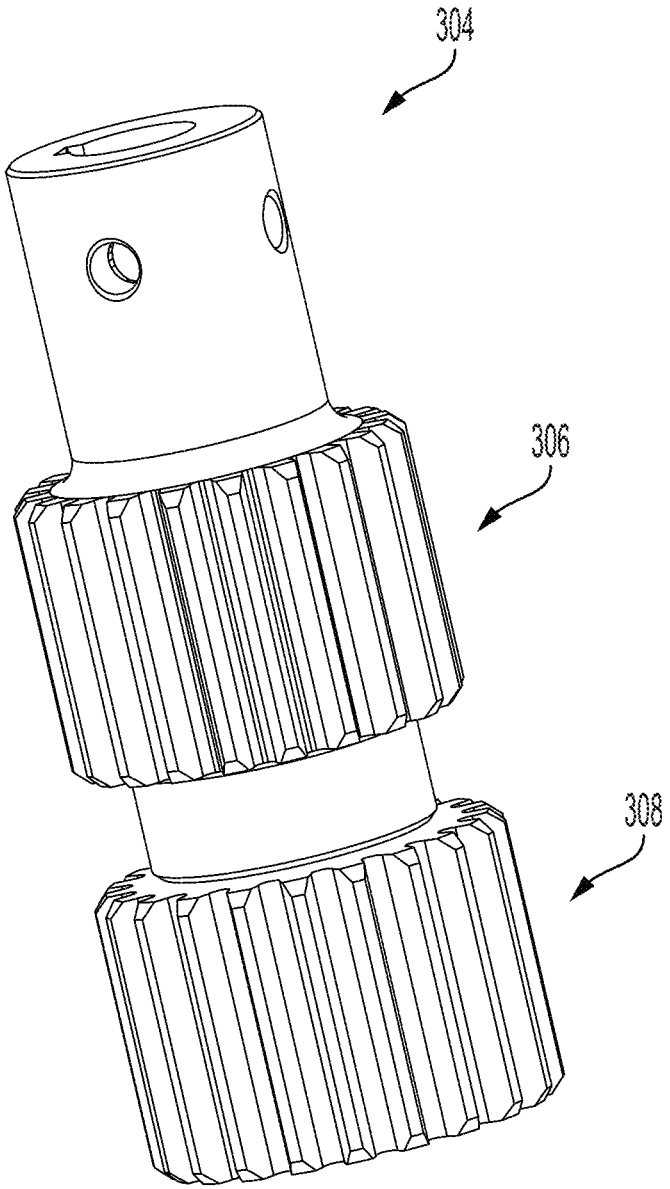
FIG. 12 is a perspective view of a sun gear assembly of the compound planetary gear of FIG. 9.
Figure 13:
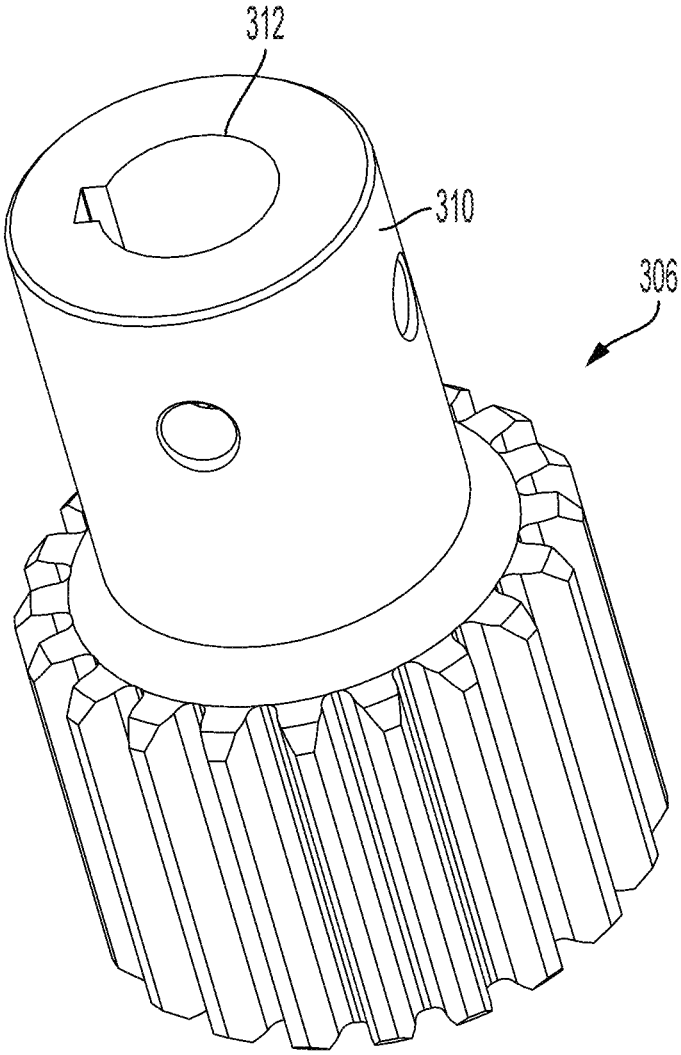
FIG. 13 is a perspective view of a first sun gear of the sun gear assembly of FIG. 12.
Figure 14:
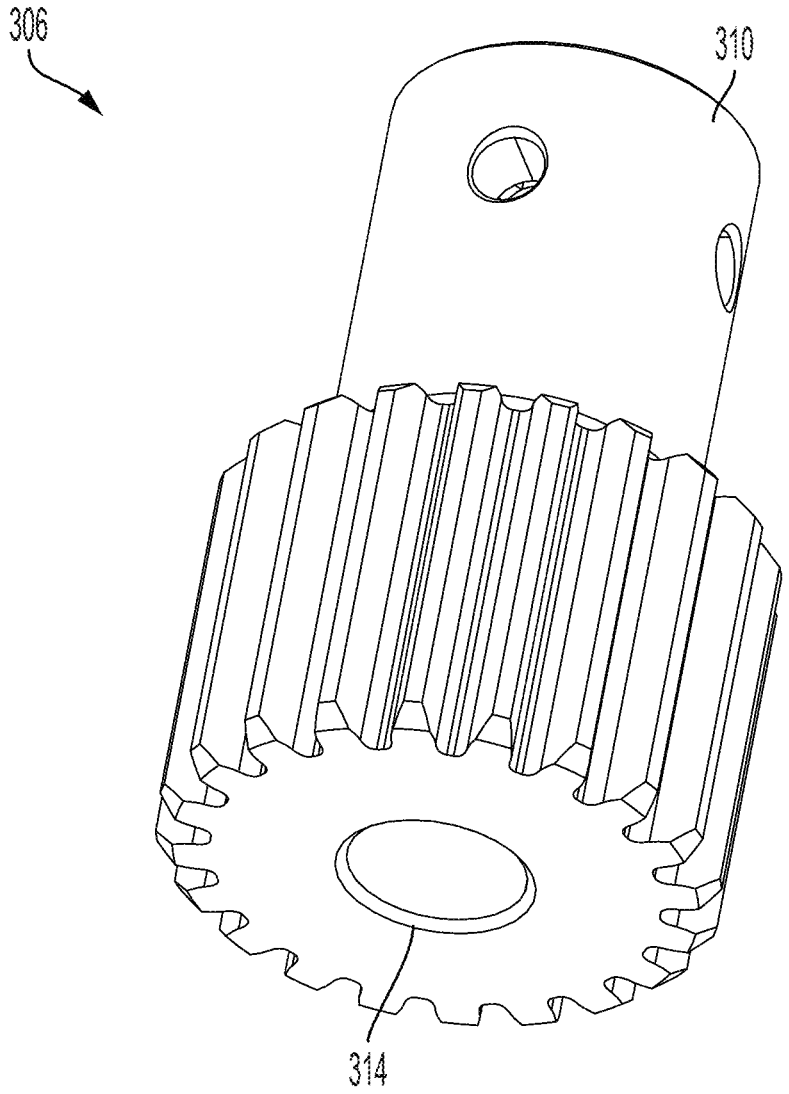
FIG. 14 is another perspective view of the first sun gear FIG. 13.

The air motor 200 is configured as best shown in FIGS. 1, 2 and 7. The air rotary system 10 comprises a single air motor. In accordance with another aspect of the subject disclosure, the air rotary system 10 consists of a single air motor. In accordance with another aspect of the subject disclosure, the air rotary system 10 consists essentially of a single air motor.

The air motor 200 is sized sufficiently to drive operations of the air rotary system 10 for the down hole drill assembly. That is, the air motor 200 is sized sufficiently to provide torque sufficiently to drive rotation of the compound planetary gear 300. The air motor 200 includes a drive shaft 202 that extends distally from a main body portion of the air motor. The drive shaft 202 includes a rib 204 extending along its length and throughout its entire longitudinal length.

The compound planetary gear 300 is configured as best shown in FIGS. 8-11 and includes a plurality of planet gears 302, also referred to as composite planet gears, and a sun gear assembly 304. In the present embodiment, the compound planetary gear includes four (4) planet gears 302, but can include more or less e.g., 2, 3, or 5 planet gears.

Each planet gear 302 includes a first stage gear 302*a* and a second stage gear 302*b* connected to the first stage gear and longitudinally arranged. That is, the first and second stage gears are connected to rotate along a single rotational axis. Each planet gear 302 can be integrally formed or rigidly connected together. The first and second stage gears are also configured to have differing radii. For example, the first stage gear has an overall radius that is larger than the overall radius of the second stage gear. In other words, the overall diameter of the first stage gear is larger than an overall diameter of the second stage gear. Each of the first and second stage gears have teeth for correspondingly engaging teeth of the outer ring gear, the output ring gear or the sun gear assembly. In accordance with an exemplary embodiment, the first and second stage gears are sized sufficiently to produce an overall gear ratio of about 50:1, 75:1, 80:1, 90:1, 100:1, 110:1, 120:1, and 150:1, but can alternatively be more or less.

The sun gear assembly 304 is configured as best shown in FIGS. 12-15 and includes a first sun gear 306 and a second sun gear 308. The first sun gear 306 includes an axis 310 having a keyed through hole 312 for receiving the drive shaft of the air motor. The first sun gear also includes a coaxial central through hole 314.

Figure 15:
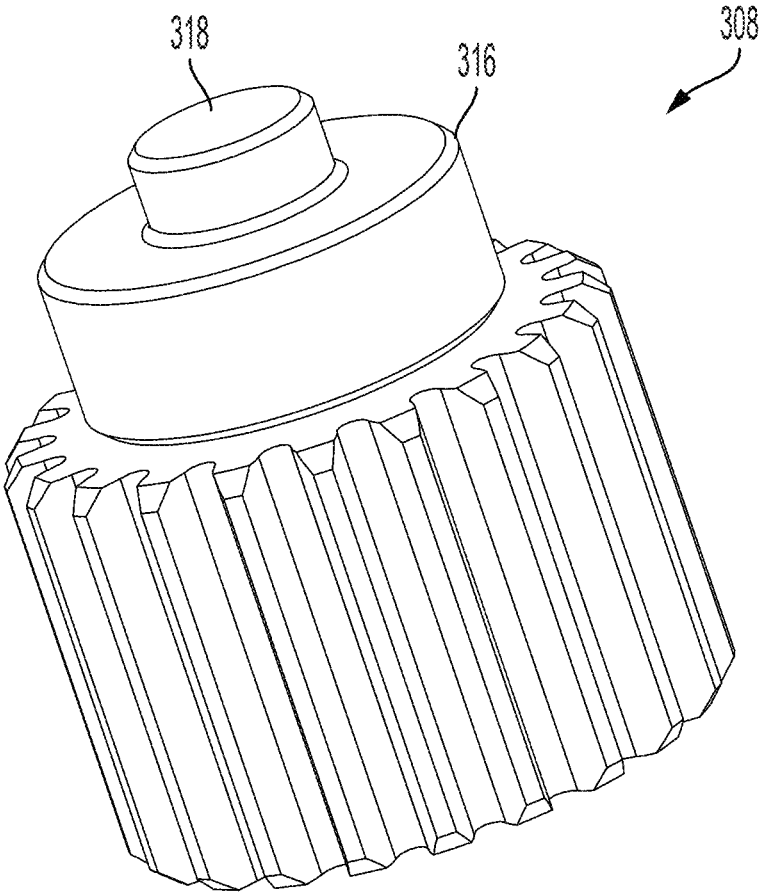
FIG. 15 is a perspective view of a second sun gear of the sun gear assembly of FIG. 12.
Figure 16:
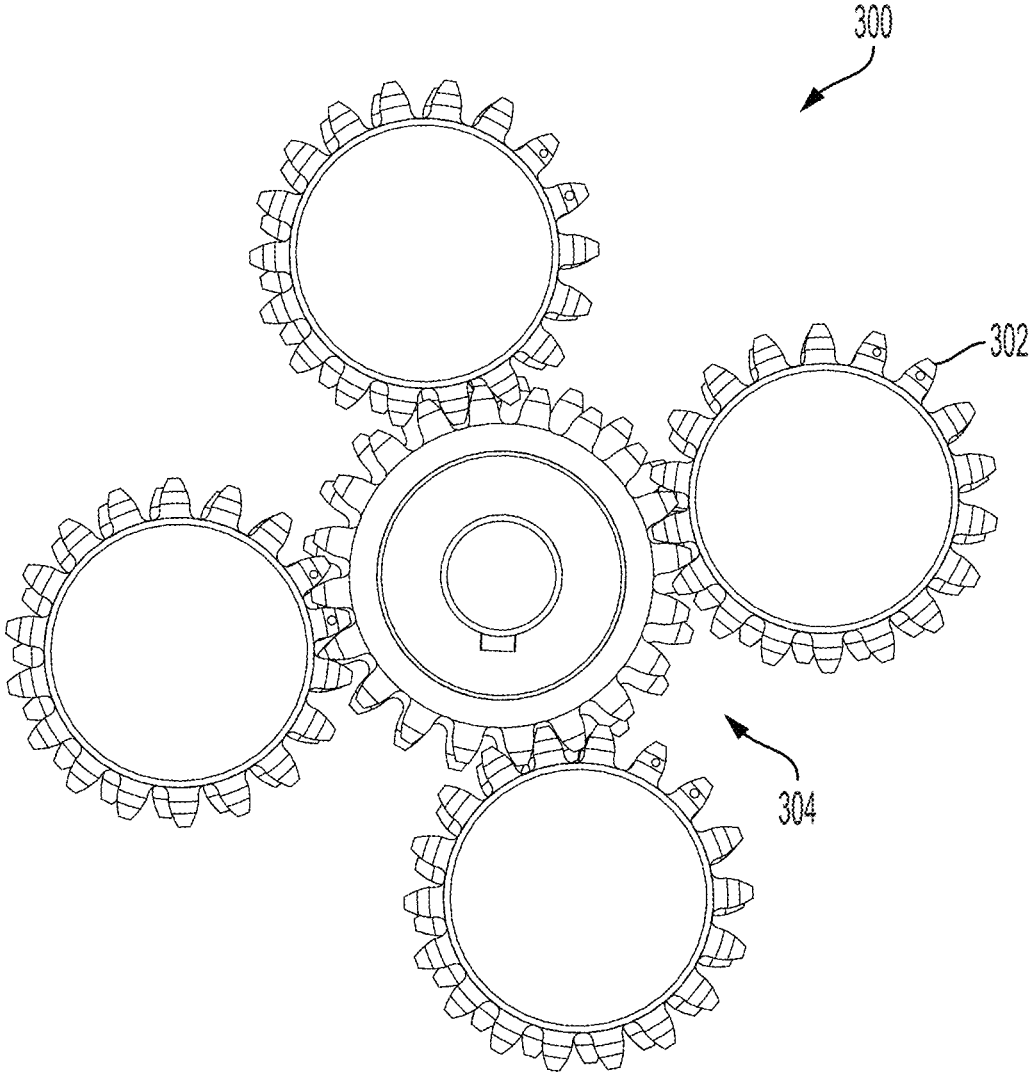
FIG. 16 is a top plan view of the compound planetary gear of FIG. 8.

The second sun gear 308 is configured as best shown in FIG. 15 having an axis 316 that includes a boss 318 for engaging with the central through hole 314 of the first sun gear. That is, the first sun gear 306 mounts to the axis 316 of the second sun gear 308 via the boss being received within the central through hole 314. The first and second sun gears are configured to rotate independently of each other and have overall gear diameters or gear radii that differ. The first sun gear is configured to have an overall gear diameter or radius for operatively engaging the first stage gears of the planetary gears, and the second sun gear is configured to have an overall diameter or radius for operatively engaging the second stage gears of the planetary gears. The second sun gear has an overall diameter that is larger than an overall diameter of the first sun gear. FIG. 16 best illustrates the arrangement of the planetary gears and sun gear assembly.

Figure 17:
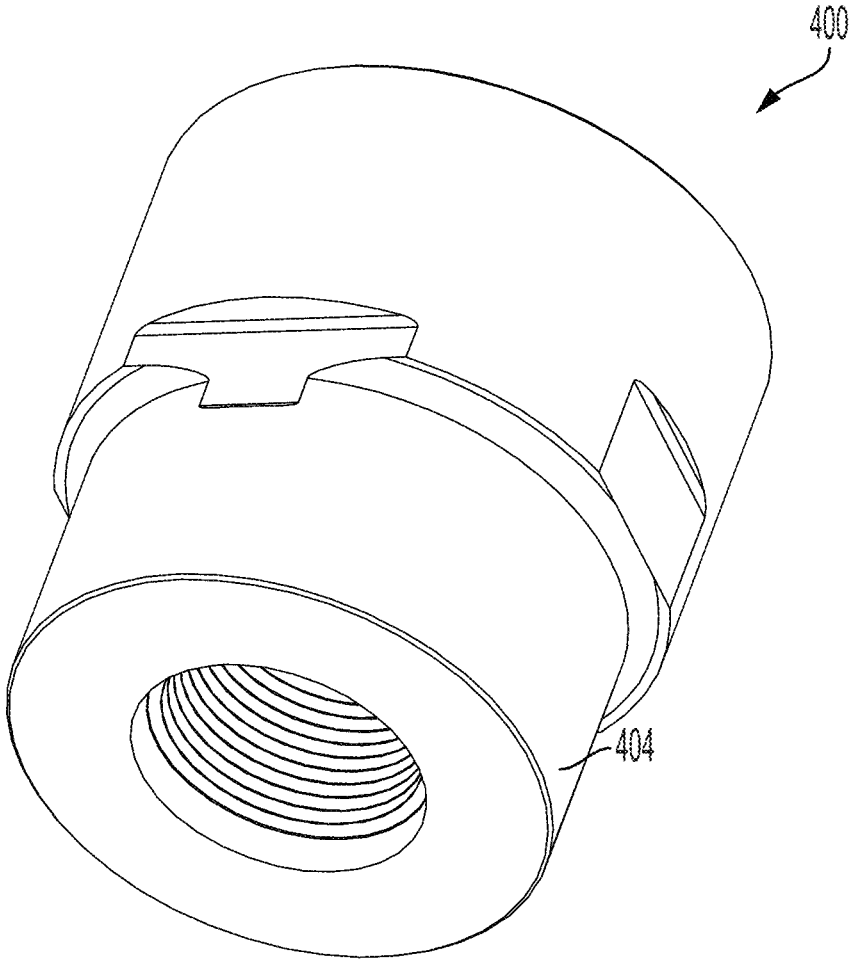
FIG. 17 is a perspective view of an output ring gear the air rotary system of FIG. 1.
Figure 18:
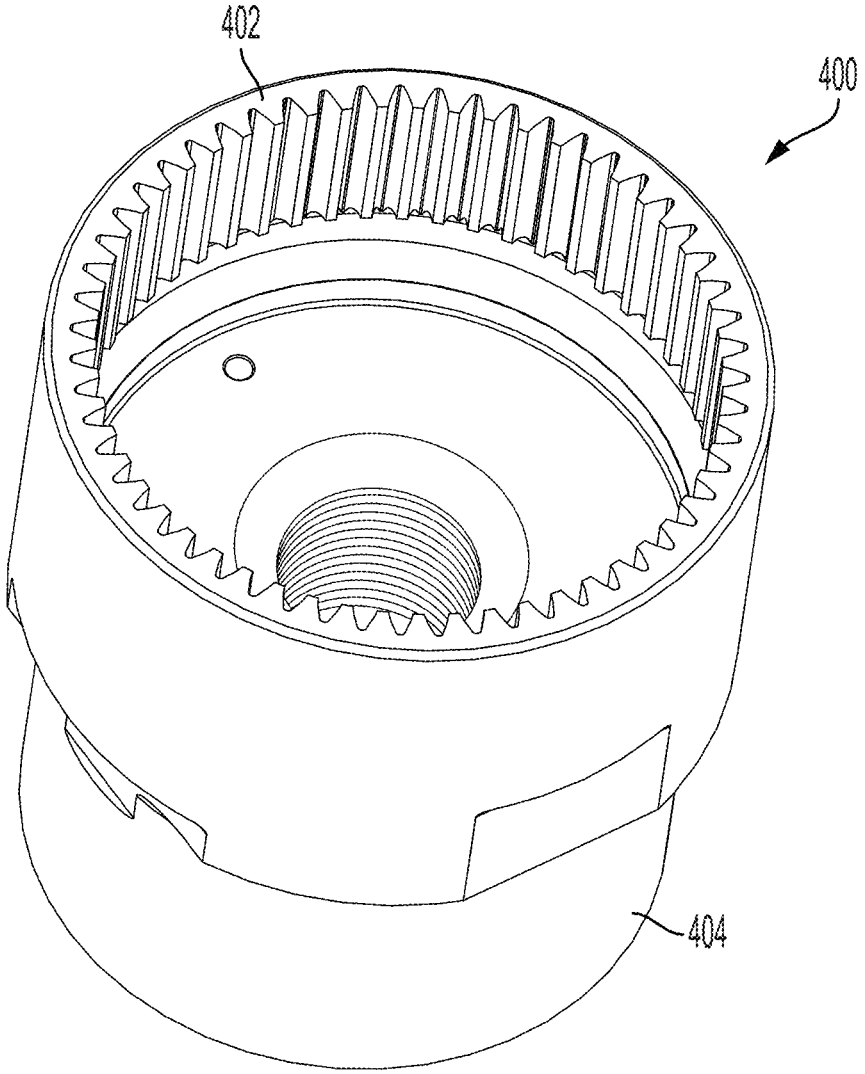
FIG. 18 is another perspective view of the output ring gear shown in FIG. 17.
Figure 19:
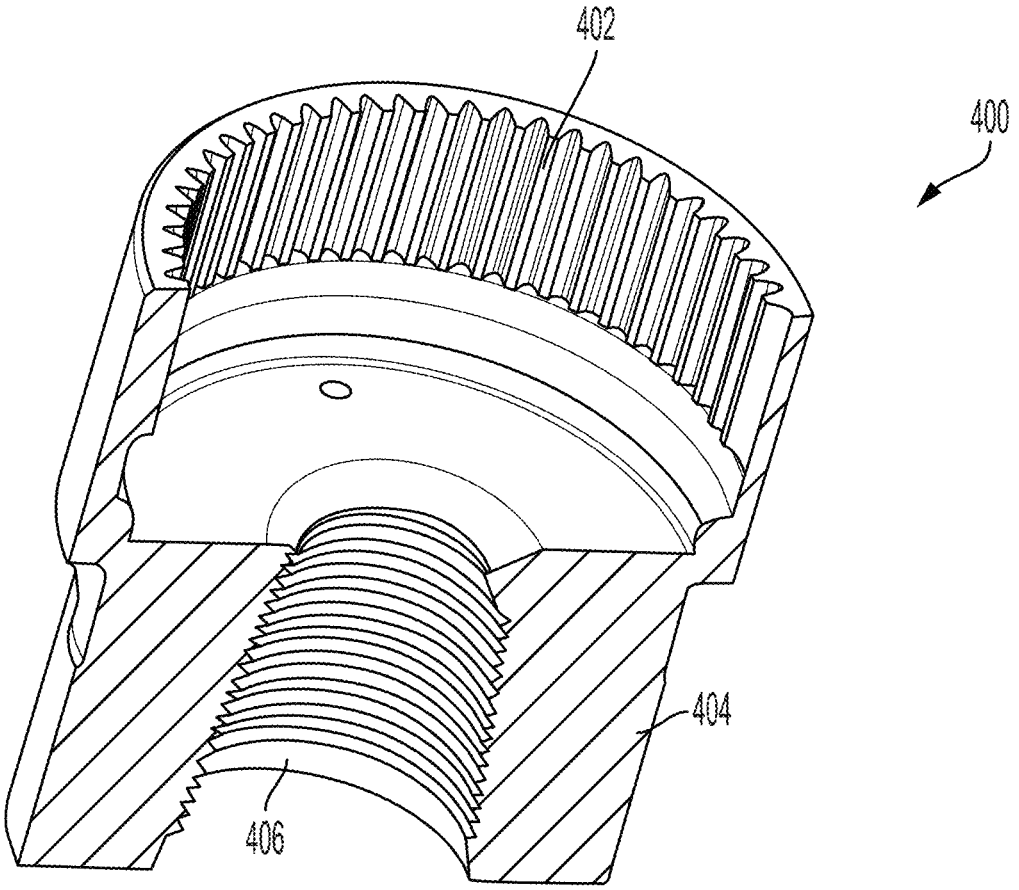
FIG. 19 is a longitudinal cross-sectional view of the output ring gear shown in FIG. 17.

The output ring gear 400 is configured as best shown in FIGS. 17-19. The output ring gear 400 includes teeth 402 for operatively engaging the second stage gears of the planetary gears and a sized to have an overall diameter smaller than an overall diameter of the outer ring gear. The output ring gear is also sized to fit or be housed within the housing 100 and free to rotate within the housing.

The output ring gear 400 also includes a connector 404 for connecting to another drilling component, e.g., such as a tool joint connection. The connector 404 can be sized to have an overall diameter smaller than the overall diameter of the output ring gear. The connector is positioned distal to or beneath the teeth of the output ring gear and includes a bore 406 e.g., a threaded bore for joining a tool thereto. The connector 404 forms a tool joint connection.

Overall, the compound planetary gear 300 of the air rotary system 10 forms a compact gear system having an overall length i.e., an overall longitudinal length, of between about 5 to 15 inches, about 8 to 10 inches, and about 9 to 10 inches, but can be more or less, e.g., 4, 6, 7, 9.5, 11, 12, 13, 14, or 15 inches. In one particular configuration, the overall length is about 9.5 inches.

Figure 20:
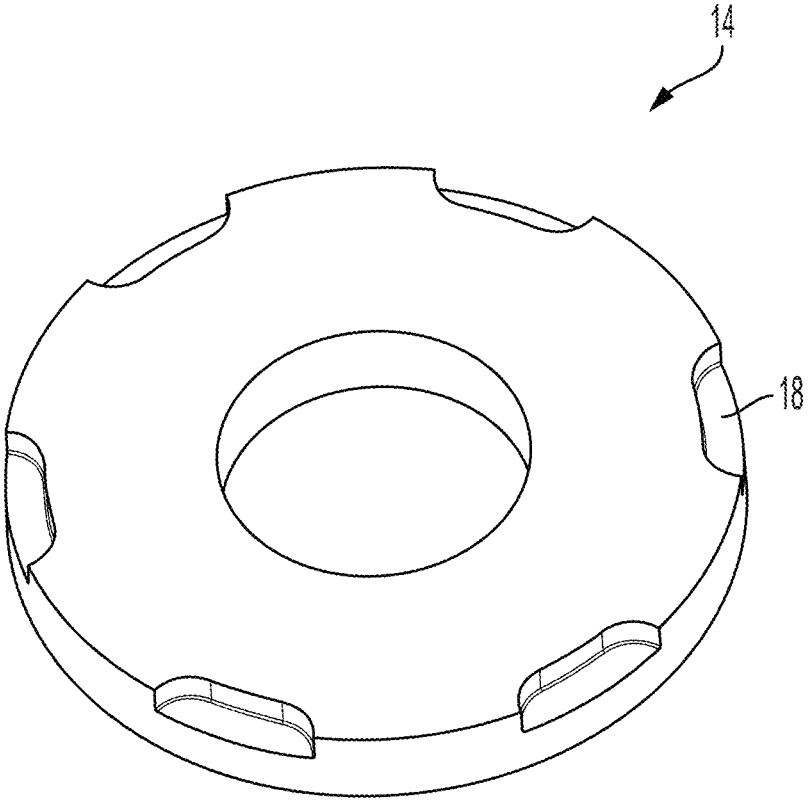
FIGS. 20 and 21 are perspective views of thrust plates for use with the compound planetary gear of FIG. 8.
Figure 21:
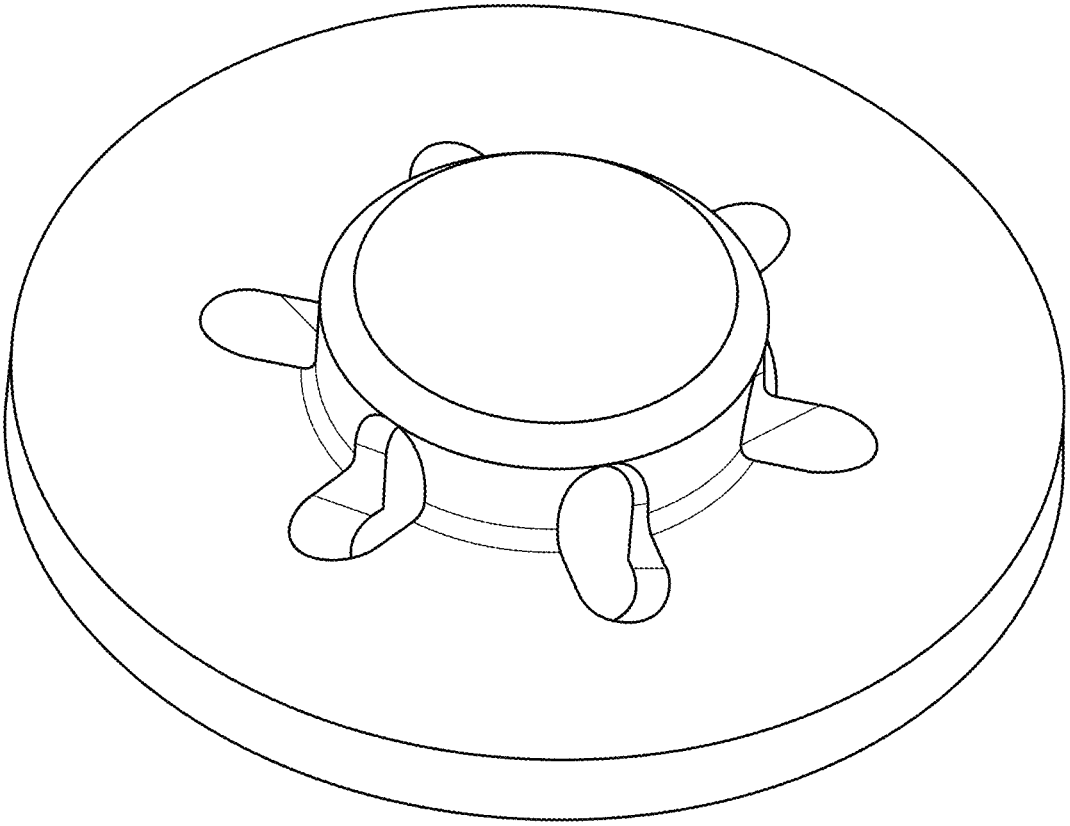

Referring to FIGS. 2 and 20, the air rotary system 10 can optionally include a thrust plate 14 mounted between the air motor and the planetary gears and a second thrust plate 16 mounted between the outer ring gear and the planetary gears. Thrust plate 14 is sandwiched between the plurality of mounts 104 and the planetary gears. The thrust plate 14 includes a plurality of reliefs 18 for receiving a distal end of each of the plurality of mounts. The second thrust plate 16 can optionally be positioned between the compound planetary gear and the connector 404, below the planetary gears when viewed as shown in FIG. 2.

Figure 3:
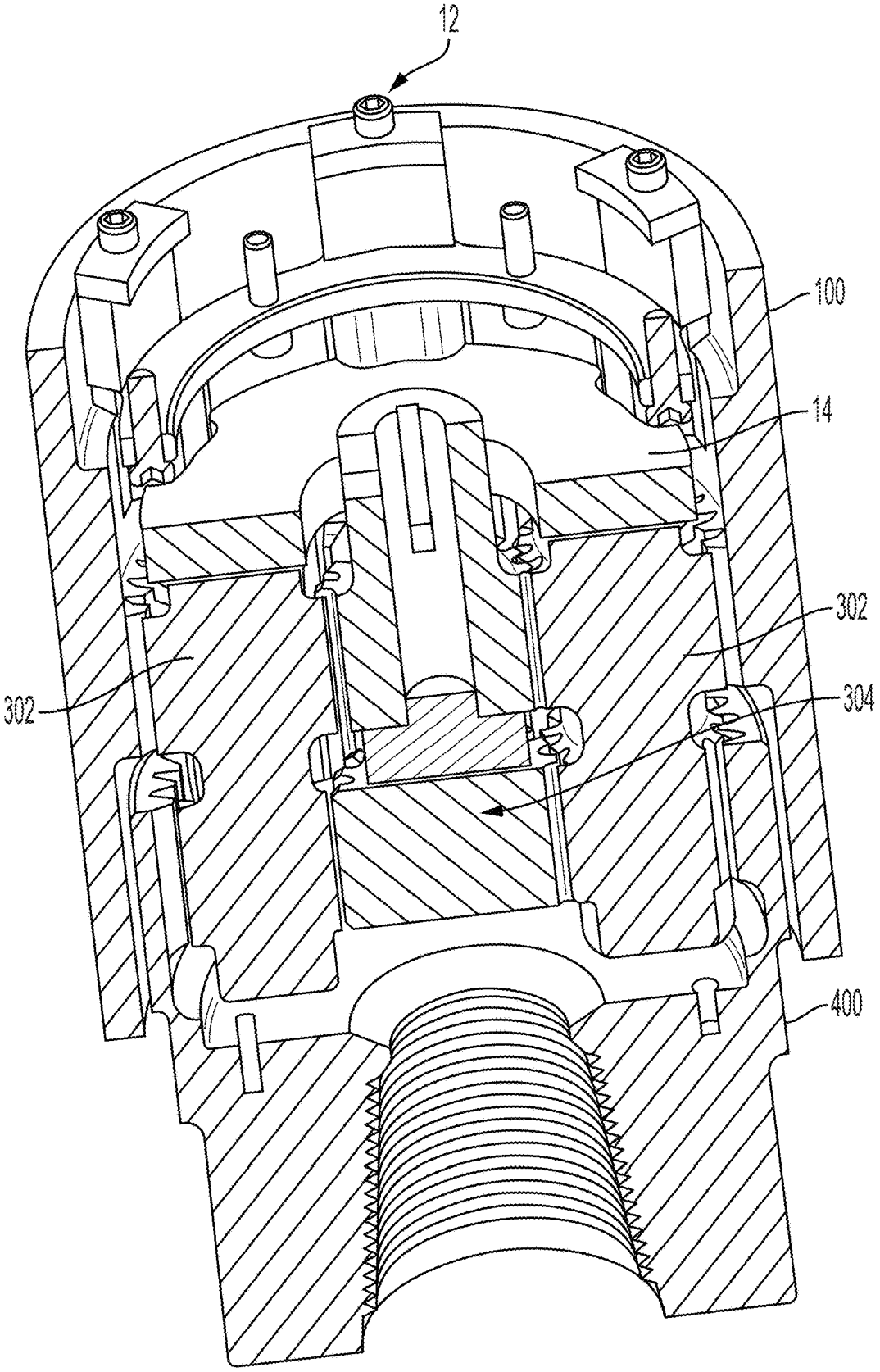
FIG. 3 is a perspective longitudinal cross-sectional view of the air rotary system of FIG. 1.
Figure 4:
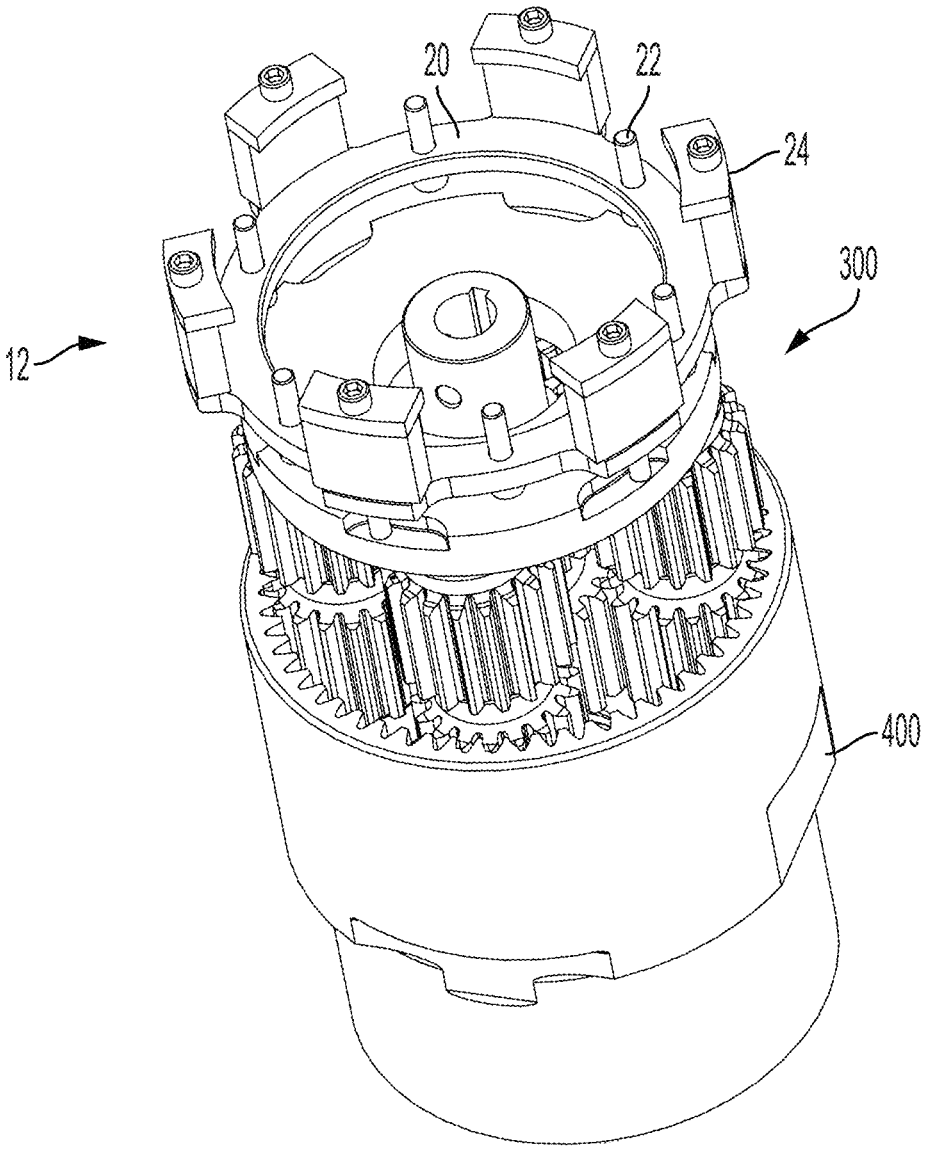
FIG. 4 is a perspective view of the air rotary system of FIG. 1 with certain components omitted for the purpose of clarity.

The mounting assembly 12 is configured as best shown in FIGS. 2-4 and includes a mounting ring 20, fasteners 22, and brackets 24 for collectively securing the air motor 100 to the housing 10. The fasteners 22 are circumferentially spread apart along the mounting ring and the brackets 24 are circumferentially spread apart along the mounting ring.

Referring to FIG. 2, the air motor has its drive shaft engaged with the shaft of the sun gear for driving rotation therewith upon operation of the air motor. Rotation of the sun gear drives rotation of the planetary gears which in turn drives rotation of the output ring gear and consequently the connector and the corresponding drill component connected to the connector.

The foregoing exemplary embodiments of the subject disclosure advantageously provides for an air rotary system that provides sufficient gear ratio while achieving adequate tooth thickness to provide a robust system suitable for down hole drilling. The compact gearing system of the air rotary system also advantageously reduces the distance from a bend in the rotary assembly to a drill bit operatively connected thereto. The air rotary system of the subject disclosure also operates without the need for any bearing which thereby reduces failures associated with down hole drills as well as oil needed for lubrication. The presently disclosed air rotary system is designed to operate with a single air motor, such as one suitable e.g., for a 12-inch pneumatic rotary system.

Figure 22:
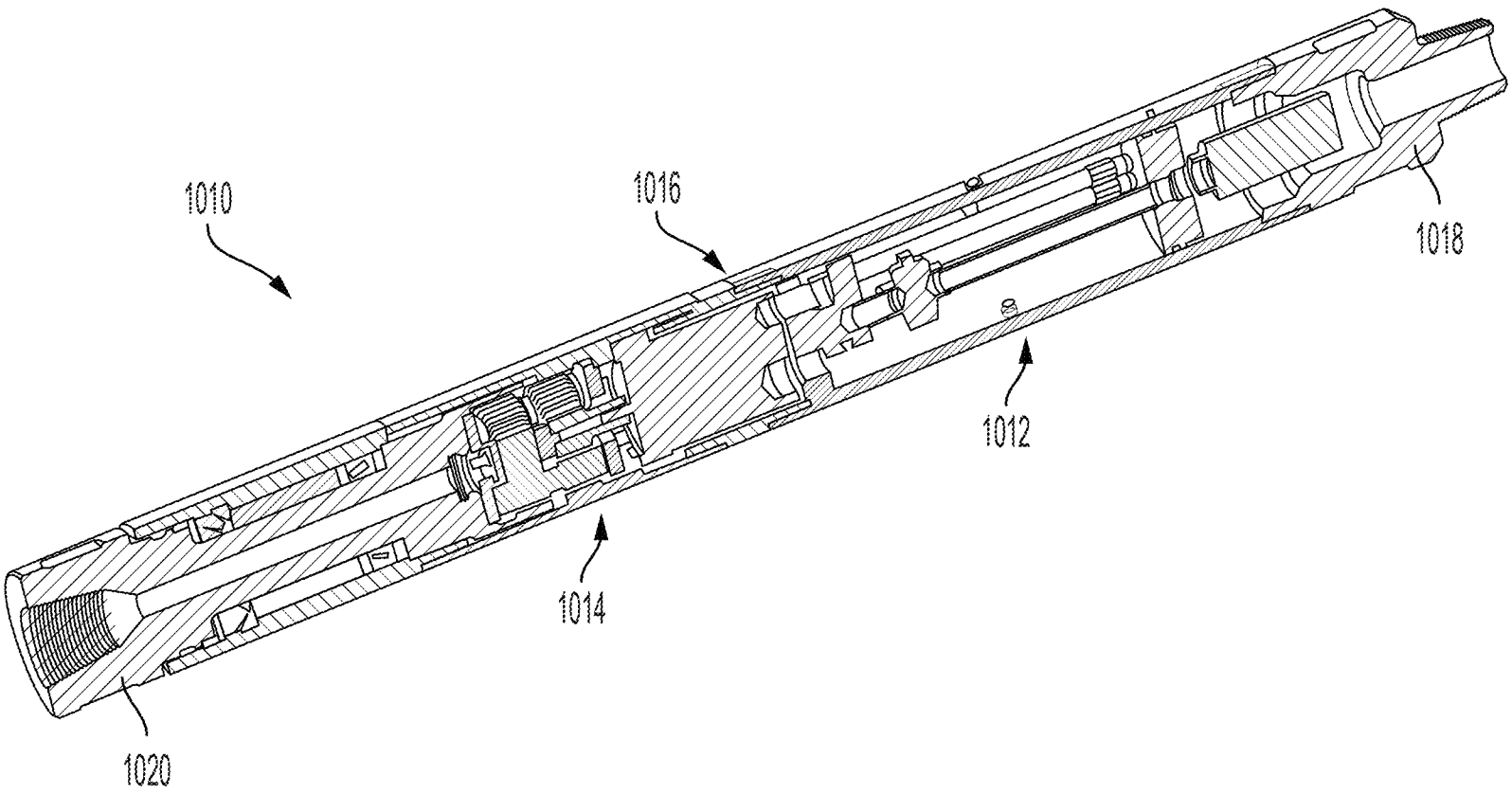
FIG. 22 is a perspective view of a down-the-hole drill assembly in accordance with another exemplary embodiment of the subject disclosure.

FIG. 22 illustrates a down hole drill assembly 1010 in accordance with another exemplary embodiment of the subject disclosure. The drill assembly 1010 includes a main housing 1012 housing an inlet air cavity and an exhaust air cavity, and an air rotary system 1014 operatively connected to the main housing via a bend attachment or bent sub 1016 . . . . The drill assembly may further include an upper tool connection joint 1018 configured to engage a drill string (not shown). The upper tool connection joint, through connection to the drill string, allows pressurized air i.e., a working fluid, to be in fluid communication with the down hole drill assembly for operation thereof. The compact and efficient nature of the an air rotary system 1014 allows the an air rotary system 1014 to be angled e.g., having its longitudinal axis be angled, greater than three (3) degrees away from the main housing, e.g., an axis of the main housing. For example, the an air rotary system 1014 may be angled from the main housing axis more or less than three degrees, e.g., 2, 4, 5, and 6 degrees. A lower tool connection joint 1020 is operatively connected to the down hole drill assembly 1010 which allows the attachment for various drilling extensions, heads, or mounts, such as a down-the-hole hammer tool assembly.

Referring back to FIGS. 1-20, alternatively expressed, the down hole drill assembly includes an air motor mounted within the main housing. The air motor may be mounted within the main housing in a variety of fashions. A plurality of motor mount L-brackets lock the air motor to a motor mount plate within the bent main housing and engage an air motor ridge formed on the exterior of the air motor. The air motor may include an air motor drive shaft. A plurality of air inlets allow compressed air from the air inlet cavity to power the air motor and turn the air motor drive shaft. The air motor may be comprised of a plurality of air vanes (not shown) that are spun by the compressed air. In other aspects, the air motor may be driven by any known air motor methodologies.

The drilling assembly further includes an upper sun gear mounted to the air motor drive shaft. The upper sun gear is fixed to the air motor drive shaft and rotates in concert. The upper sun gear defines an upper sun gear diameter and includes a plurality of upper sun gear teeth. The drilling assembly further includes a first stage ring gear and a second stage ring gear. In one aspect of the disclosure, the first stage ring gear is formed on the interior main housing surface of the bent main housing. In another aspect of the disclosure the second stage ring gear is formed on the interior tool mount surface of the tool mount housing. The first stage ring gear defines a first stage ring gear diameter and comprises a plurality of first stage ring gear teeth. The second stage ring gear defines a second stage ring gear diameter and comprises a plurality of second stage ring gear teeth.

The drilling assembly further includes a plurality of compound planet gears. The plurality of compound planet gears is mounted around the upper sun gear and rotate in concert with the upper sun gear. In an aspect, the plurality of compound planet gears comprises four (4) compound planet gears. In an aspect, each of the plurality of compound planet gears includes a planet gear shaft. Fixed to the planet gear shaft is an upper planet gear defining an upper planet gear diameter and comprising a plurality of upper planet gear teeth. Also fixed to the planet gear shaft is a lower planet gear defining a lower planet gear diameter and comprising a plurality of lower planet gear teeth. In one aspect of the disclosure, the upper planet gear diameter is greater than the lower planet gear diameter. In another aspect, the number of upper planet gear teeth is greater than the number of lower planet gear teeth. The upper sun gear is in direct contact with the upper planet gear teeth. The upper planet gear is positioned in between the upper sun gear and the first stage ring gear. Since the first stage ring gear is attached to the interior main housing surface, rotation of the upper planet gear driven by the planet gear shaft rotates the plurality of compound planet gears around the first stage ring gear. The plurality of compound planet gears is movably held in location by an upper thrust plate slidably engaging a first shaft end of the planet gear shaft. A lower thrust plate similarly slidably engages a second shaft end of the planet gear shaft allowing the plurality of compound planet gears to rotate around the first stage ring gear. The use of thrust plates in combination with the shaft ends allows the planetary gearing system to rotate without bearings or gear housings. The elimination of bearings reduces the chances of failure should debris enter the system. The absence of bearings also reduces the amount of oil needed for lubrication. The gears are lubricated by an oil mist injected into the air through an oil injection system (not shown). In an alternate aspect, it is contemplated that the upper planet gear and lower planet gear may be formed as a continuous gear on the planet gear shaft.

In an aspect of the disclosure, the drilling assembly further includes a lower sun gear aligned with the upper sun gear and separated by a ram button. In one aspect, the lower sun gear is fixed and does not rotate in concert with the upper sun gear. The ram button allows the upper sun gear to rotate independently from the lower sun gear. The lower planet gears are positioned in between the lower sun gear and the second stage ring gear. When the upper sun gear rotates the plurality of upper planet gears around the first stage ring gear, the lower planet gears rotate around the lower sun gear and, in turn, rotates the tool mount housing. This is utilized to rotate the hammer tool or other drill bit.

In one aspect of the disclosure, the gearing ratio between the upper sun gear input and the second stage ring gear output can be controlled by adjusting the diameters and numbers of teeth in the upper sun gear, the lower sun gear, the upper planet gear, the lower planet gear, the first stage ring gear and the second stage ring gear. In one aspect, the first stage ring gear diameter is greater than the second stage ring gear diameter. In an aspect, the plurality of first stage ring gear teeth are greater in number than the plurality of second stage ring gear teeth. The upper planet gear diameter is greater than the lower planet gear diameter. The plurality of upper planet gear teeth is greater than the plurality of lower planet gear teeth. In one aspect, the diameters and number of teeth may be adjusted to achieve a system rotational ratio of 90:1 to 110:1 and produce a rotation of 30 rpm to 60 rpm in the tool mount housing 1034.

In an exemplary embodiment, the compound planet gear has a sun gear assembly with about 20 teeth, first stage gears with about 18 teeth and a diameter of about 80 mm, second stage gears with about 17 teeth and a diameter of about 76 mm, outer ring gear with about 56 teeth and a diameter of about 224 mm, and output ring gear with about 55 teeth and a diameter of about 220 mm.

It will be appreciated by those skilled in the art that changes could be made to the exemplary embodiments described above without departing from the broad inventive concept thereof. It is to be understood, therefore, that this disclosure is not limited to the particular exemplary embodiments disclosed, but it is intended to cover modifications within the spirit and scope of the subject disclosure as defined by the appended claims.

I claim:

1. An air rotary system for a down-the-hole drill assembly comprising:

a housing;

an air motor mounted within the housing;

a compound planetary gear mounted within the housing;

an output ring gear operatively engaged with the compound planetary gear; and a trust plate between the output ring and the compound planetary gear.

2. The air rotary system of claim 1, further comprising a thrust plate between the air motor and the compound planetary gear.

3. The air rotary system of claim 1, further comprising a mounting assembly for mounting the air motor to the housing.

4. The air rotary system of claim 1, wherein the housing comprises an outer ring gear.

5. The air rotary system of claim 1, wherein the housing comprises an outer ring gear integrally formed on an inner surface of the housing.

6. The air rotary system of claim 1, wherein the air motor is operatively connected to the compound planetary gear for driving rotation thereof.

7. The air rotary system of claim 1, wherein the compound planetary gear comprises a planet gear having a pair of gears connected and longitudinally arranged.

8. The air rotary system of claim 7, wherein each of the pair of gears have differing radii.

9. The air rotary system of claim 7, wherein the pair of gears are sized sufficiently to produce an overall gear ratio of about 90:1 to 100:1.

10. The air rotary system of claim 1, wherein the compound planetary gear comprises a sun gear assembly operatively engaged with the air motor.

11. The air rotary system of claim 1, wherein the compound planetary gear comprises a planet gear having a first stage gear engaged with the outer ring gear and a second stage gear connected to the first stage gear and operatively engaged with the output ring gear.

12. The air rotary system of claim 1, wherein the output ring gear comprises a connector for connecting to a drilling component.

13. The air rotary system of claim 1, wherein the output ring gear has a diameter sized less than a diameter of the outer ring gear.

14. A down-the-hole drill assembly comprising:

a first tool joint connection;

a bent sub connected to the first tool joint connection; and an air rotary system operatively connected to the bent sub, the air rotary system comprising:

a housing, a single air motor mounted within the housing, a compound planetary gear mounted within the housing, an output ring gear operatively engaged with the compound planetary gear, and a trust plate between the output ring and the compound planetary gear.

15. The down-the-hole drill assembly of claim 14, further comprising a second tool joint connection connected to the air rotary system.

16. A down-the-hole drill assembly comprising:

a main housing having an exterior main housing surface and an interior main housing surface;

a tool mount housing having an exterior tool mount surface and an interior tool mount surface, the tool mount housing rotatably engaging the main housing;

an air motor mounted within the main housing, the air motor including an air motor drive shaft;

an air inlet cavity in communication with the air motor;

an upper sun gear attached to the air motor drive shaft;

a first stage ring gear positioned within the main housing on the interior main housing surface;

a second stage ring gear positioned within the tool mount housing on the interior tool mount housing surface; and a plurality of compound planet gears, each of the plurality of planet gears comprising:

a planet gear shaft, an upper planet gear fixed on the planet gear shaft, the upper planet gear having an upper planet gear diameter, the upper planet gear positioned in between the upper sun gear and the first stage ring gear, and a lower planet gear fixed on the planet gear shaft fixed on the planet gear shaft, the lower planet gear having a lower planet gear diameter, the lower planet gear positioned in between a lower sun gear and the second stage ring gear;

wherein the upper sun gear rotates the upper planet gear around the first stage ring gear, the upper planet gear rotates the lower planet gear, and the lower planet gear rotates the second stage ring gear which in turn rotates the tool mount housing.

17. The down-the-hole drill assembly of claim 16, wherein the main housing comprises:

a first main housing having a main housing axis; and a bent main housing having a bent main housing axis;

wherein the bent main housing axis is angled relative to the main housing axis.

18. The down-the-hole drill assembly of claim 16, wherein the second stage gear has a second stage gear diameter, and the first stage gear has a first stage gear diameter larger than the second stage gear diameter.

19. The down-the-hole drill assembly of claim 18, wherein a rotational ratio of the upper sun gear rotation to the second stage ring gear rotation is between 90:1 and 110:1.

20. An air rotary system for a down-the-hole drill assembly comprising:

a housing comprising an outer ring gear;

an air motor mounted within the housing;

a compound planetary gear mounted within the housing; and an output ring gear operatively engaged with the compound planetary gear.

21. An air rotary system for a down-the-hole drill assembly comprising:

a housing;

an air motor mounted within the housing;

a compound planetary gear mounted within the housing, wherein the compound planetary gear comprises a planet gear haVing a pair of gears connected and longitudinally arranged; and an output ring gear operatively engaged with the compound planetary gear.

22. An air rotary system for a down-the-hole drill assembly comprising:

a housing;

an air motor mounted within the housing;

a compound planetary gear mounted within the housing; and an output ring gear operatively engaged with the compound planetary gear, wherein the compound planetary gear comprises a planet gear haVing a first stage gear engaged with an outer ring gear and a second stage gear connected to the first stage gear and operatively engaged with the output ring gear.

23. A down-the-hole drill assembly comprising:

a first tool joint connection;

a bent sub connected to the first tool joint connection; and an air rotary system operatively connected to the bent sub, the air rotary system comprising:

a housing comprising an outer ring gear, a single air motor mounted within the housing, a compound planetary gear mounted within the housing, and an output ring gear operatively engaged with the compound planetary gear.

24. A down-the-hole drill assembly comprising:

a first tool joint connection;

a bent sub connected to the first tool joint connection; and an air rotary system operatively connected to the bent sub, the air rotary system comprising:

a housing, a single air motor mounted within the housing, a compound planetary gear mounted within the housing, wherein the compound planetary gear comprises a planet gear haVing a pair of gears connected and longitudinally arranged, and an output ring gear operatively engaged with the compound planetary gear.

25. A down-the-hole drill assembly comprising:

a first tool joint connection;

a bent sub connected to the first tool joint connection; and an air rotary system operatively connected to the bent sub, the air rotary system comprising:

a housing, a single air motor mounted within the housing, a compound planetary gear mounted within the housing, and an output ring gear operatively engaged with the compound planetary gear, wherein the compound planetary gear comprises a planet gear having a first stage gear engaged with an outer ring gear and a second stage gear connected to the first stage gear and operatively engaged with the output ring gear.

* * * * *